United States Patent [19]

Mullins

[11] 4,182,030

[45] Jan. 8, 1980

[54] APPARATUS FOR FEEDING AND CRIMPING ELECTRICAL CONTACTS

[75] Inventor: Jerry M. Mullins, Arlington, Tex.

[73] Assignee: Vought Corporation, Dallas, Tex.

[21] Appl. No.: 811,515

[22] Filed: Jun. 30, 1977

[51] Int. Cl.[2] ..... H01R 43/04

[52] U.S. Cl. ..... 29/753; 29/759; 29/809; 29/823; 198/389; 198/391

[58] Field of Search ..... 29/753, 759, 823, 809; 198/389, 391; 221/204

[56] References Cited

U.S. PATENT DOCUMENTS

| | | | |
|---|---|---|---|
| 3,165,139 | 1/1965 | Whitney, Jr. | 29/753 X |
| 3,460,230 | 8/1969 | Moulin | 29/753 X |
| 3,523,316 | 8/1970 | Alexander | 29/809 X |
| 3,774,806 | 11/1973 | Swart et al. | 198/389 X |

*Primary Examiner*—Carl E. Hall

*Attorney, Agent, or Firm*—James M. Cate

[57] ABSTRACT

Apparatus for serially feeding and crimping a plurality of electrical contacts of the type having an open-ended, ferrule head portion adapted to receive an uninsulated end of an electrical wire and to be crimped into electrically conductive contact therewith. The contacts are serially discharged from an annular hopper and caused to attain an upright position. First and second tracks, mutually aligned and vertically spaced one from the other, are provided for transporting the electrical contacts, while in the upright position, from the hopper to a mechanism for feeding the contacts into a crimping chamber. The tracks have a downward inclination from the hopper which is insufficient to permit sliding movement of the contacts absent vibratory movement of the tracks, which movement is derived from a vibratory device connected to the hopper. Vibration transfer from the first to the second track is effected through the electrical contacts and, in a preferred embodiment, through a vibratory support unit connected to the second track and to the vibrating device. In a preferred embodiment, the first track, connected to the hopper, extends beneath the second track for increasing the kinetic energy of electrical contacts which transfer vibratory movement from the first to the second track and for preventing passage of any longitudinally interconnected contacts from the first to the second track.

6 Claims, 9 Drawing Figures

APPARATUS FOR FEEDING AND CRIMPING ELECTRICAL CONTACTS

This invention relates to article-handling apparatus and, more particularly, to crimping machines in which electrical contacts are serially advanced from a supply of such contacts and crimped to the ends of electrical wires.

In the past, various types of apparatus have been employed for automatically feeding electrical contacts, of the type having a metallic, ferrule head portion, into a crimping mechanism in which they are crimped onto bare end portions of electrical wires for providing electrical and physical connection therebetween. Such apparatus include mechanisms for containing, serially advancing, orienting, and feeding the contacts into the crimping chamber or dies of a crimping tool. Typically, a crimping chamber is open to permit the insertion of a wire end into the open end of a ferrule head of each contact prior to crimping. Because such electrical contacts are manufactured in various sizes and shapes, one prior-art apparatus employs a pneumatically powered feeding system in which the articles are propelled along several lengths of tubing, to avoid the use of feeding tracks having a gage corresponding only to contacts of a particular configuration. The pneumatic conveyance system is operable to advance the contacts from a reservoir or hopper and then sequentially to a feeding apparatus operable to advance respective ones of the articles, in an appropriate orientation, into a crimping mechanism. While such an apparatus provides the advantage of accommodating electrical contacts of a variety of configurations and sizes, the requirement for pneumatic feeding and orienting mechanisms entails a rather complex structure in which the parts are not readily accessible as they are transferred and oriented. Because of the difficulty of access to the articles within the pneumatic transporting and orienting passageways, maintenance is more difficult should one of the passageways become obstructed or jammed. In other apparatus not employing a pneumatic feeding system, the articles are commonly fed through a downwardly inclined ramp or track connected between a hopper and a feeding mechanism which feeds the articles to a crimping machine. The tracks through which the articles are fed are commonly gravity powered; that is, sloped downwardly at a sufficient inclination to insure that the articles are slideably translated along the length of the track. Mechanisms for transferring and feeding the contacts are mounted at the lower end of the track for sequentially gripping and transferring the articles into alignment with crimping dies or a crimping chamber of a crimping machine. Such gravity feeding tracks, however, have a tendency to jam, in that the articles are not always symmetrically aligned as they descend but rather tend to overlap one another at various angles; in certain apparatus, the lower end portion of the track must then curve toward a more horizontal path in order that the articles may be fed into the feeding and crimping mechanisms at a desired orientation. In my experimetation, it has been found desirable for consistent feeding that the articles be mutually aligned in side-by-side orientation as they are passed in seriatim along the feeding track, and that they pass into the feeding mechanism without undergoing substantial changes in attitude.

In a typical industrial application of such crimping machines, the operators of the machines do not possess the skills necessary to perform maintenance or repair work, and a malfunction of a machine is thus particularly undesirable from an economic viewpoint in that the operator may be idled or put to less productive work during the down time, while at the same time the services of a skilled maintenance worker are required. It is, of course, desirable for establishing efficient and consistent production runs that continuously reliable operation be achieved. It would, accordingly, be a significant advancement in the art if an automatically fed crimping apparatus could be devised which is reliably operable at high production rates and yet at the same time is of practicable construction, employing few moving parts.

It is, accordingly, a major object of the present invention to provide a new and improved article handling, feeding, and crimping apparatus.

Another object is to provide such a system in which electrical contacts are advanced in seriatim along downwardly inclined tracks leading to a feeding mechanism, the tracks being inclined to a degree insufficient to permit sliding movement of the articles absent vibratory movement of the tracks.

Another object is to provide such an apparatus which obviates the need for complex orienting and feeding mechanisms and which requires no pneumatic, article-advancing means.

Yet another object is to provide such an apparatus which may be conveniently maintained in operating condition, and which provides highly reliable service with little maintenance.

A further object is to provide an apparatus with the above-listed advantages which nevertheless is not more complex and expensive than existing devices but, in fact, is of practical and relatively inexpensive manufacture, employing few moving parts.

Other objects and advantages will be apparent from the specification and claims and from the accompanying drawing illustrative of the invention.

Figure 2:
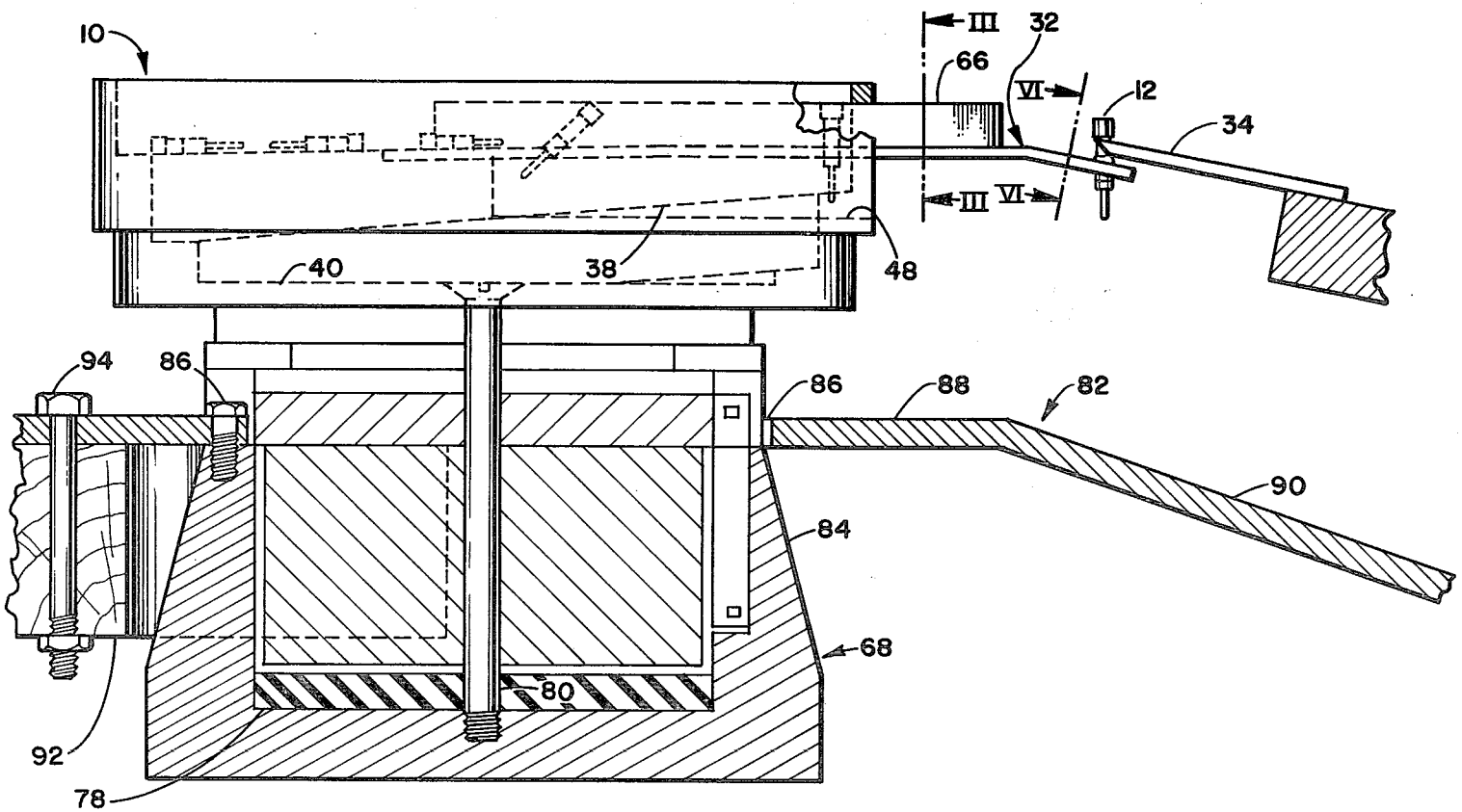
FIG. 2 is a cross-sectional view of the hopper and the vibratory mechanism, the latter being shown in partially diagrammatic form, and a longitudinal, sectional view of the vibratory support unit, the first track, and portions of the second track.
Figure 4A:
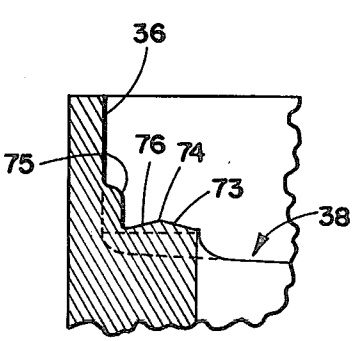
FIG. 4 is a plan view of the discharge portion of the hopper and showing the guide structure and portions of the first track structure.
Figure 4:
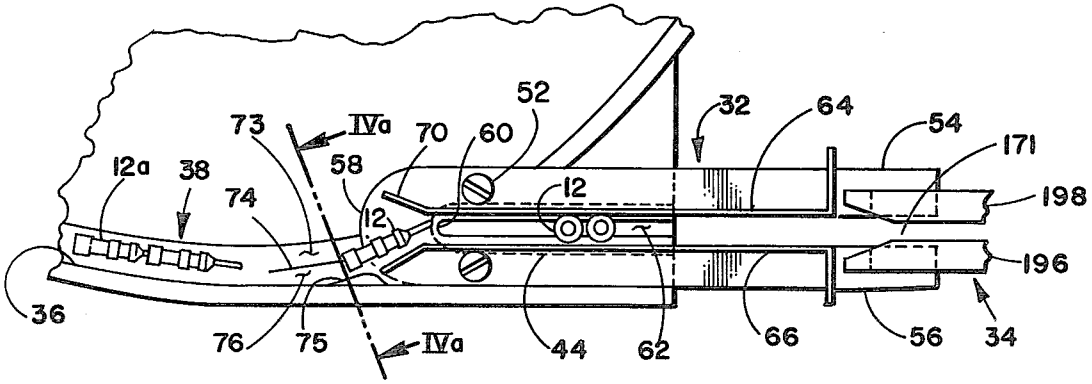
Figure 5:
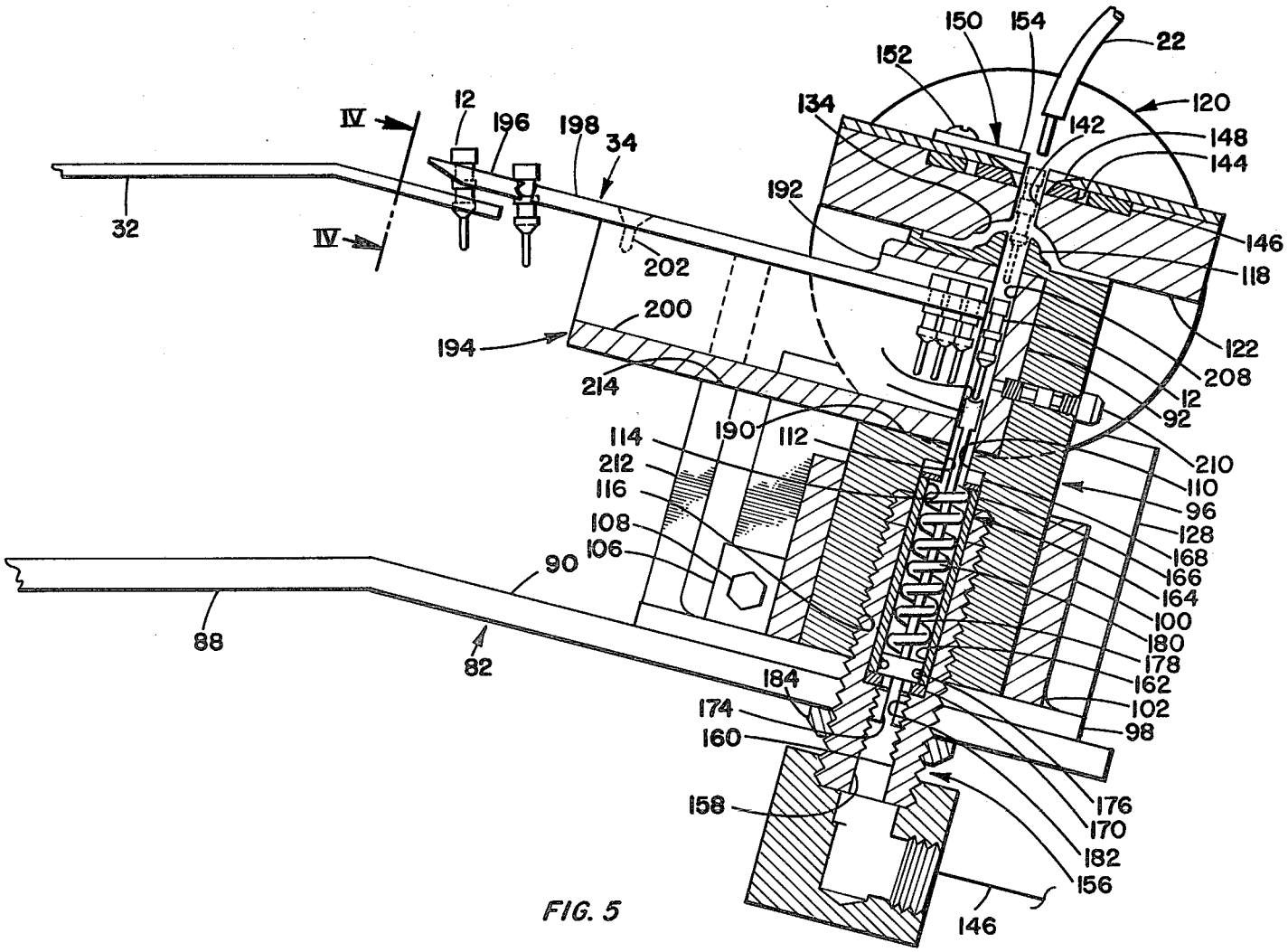
Figure 6:
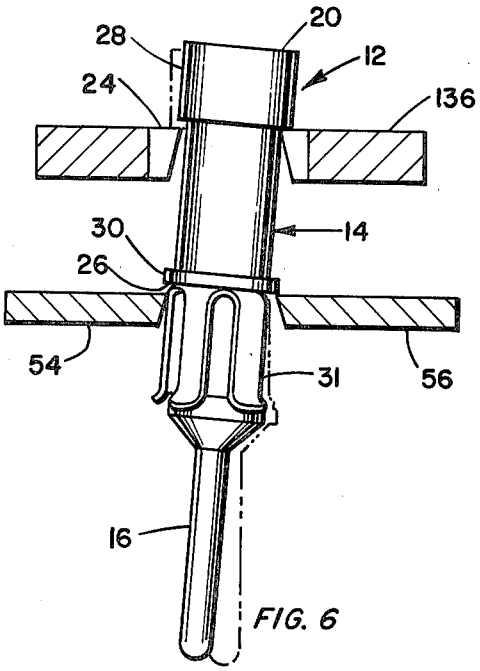
Figure 8:
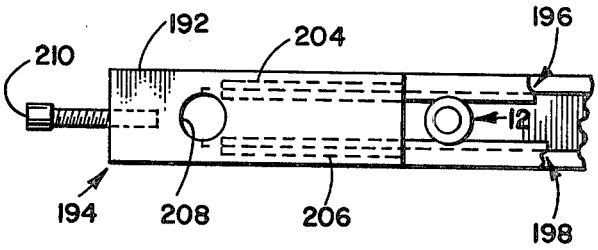
Figure 7:
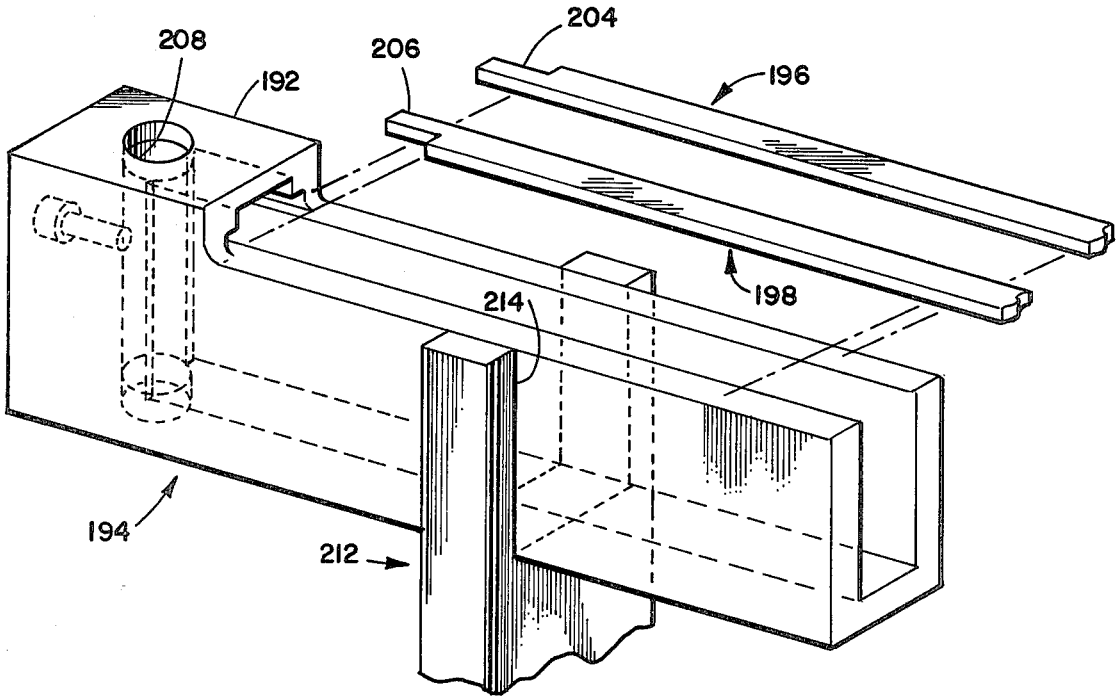

FIG. 4*a* is a cross-sectional, fragmentary view of a portion of the spiral pathway of the hopper, taken as on line IV*a*—IV*a* of FIG. 4, and showing the means for rejecting mutually interconnected contacts;

FIG. 5 is a longitudinal, sectional view of the article feeding mechanism, the vibratory support unit, and the crimping mechanism, together with a longitudinal view of the second track structure and of portions of the first track structure;

FIG. 6 is a cross-sectional view of the first and second track structures taken as on line VI—VI of FIG. 2 and showing one of the electrical contacts; and FIG. 7 is a perspective, exploded view on an enlarged scale, of the second track structure and the longitudinal support structure therefor;

FIG. 8 is a plan view of a portion of the structure of FIG. 7 taken as looking downwardly upon the enlarged portion of the longitudinal support structure.

Figure 1:
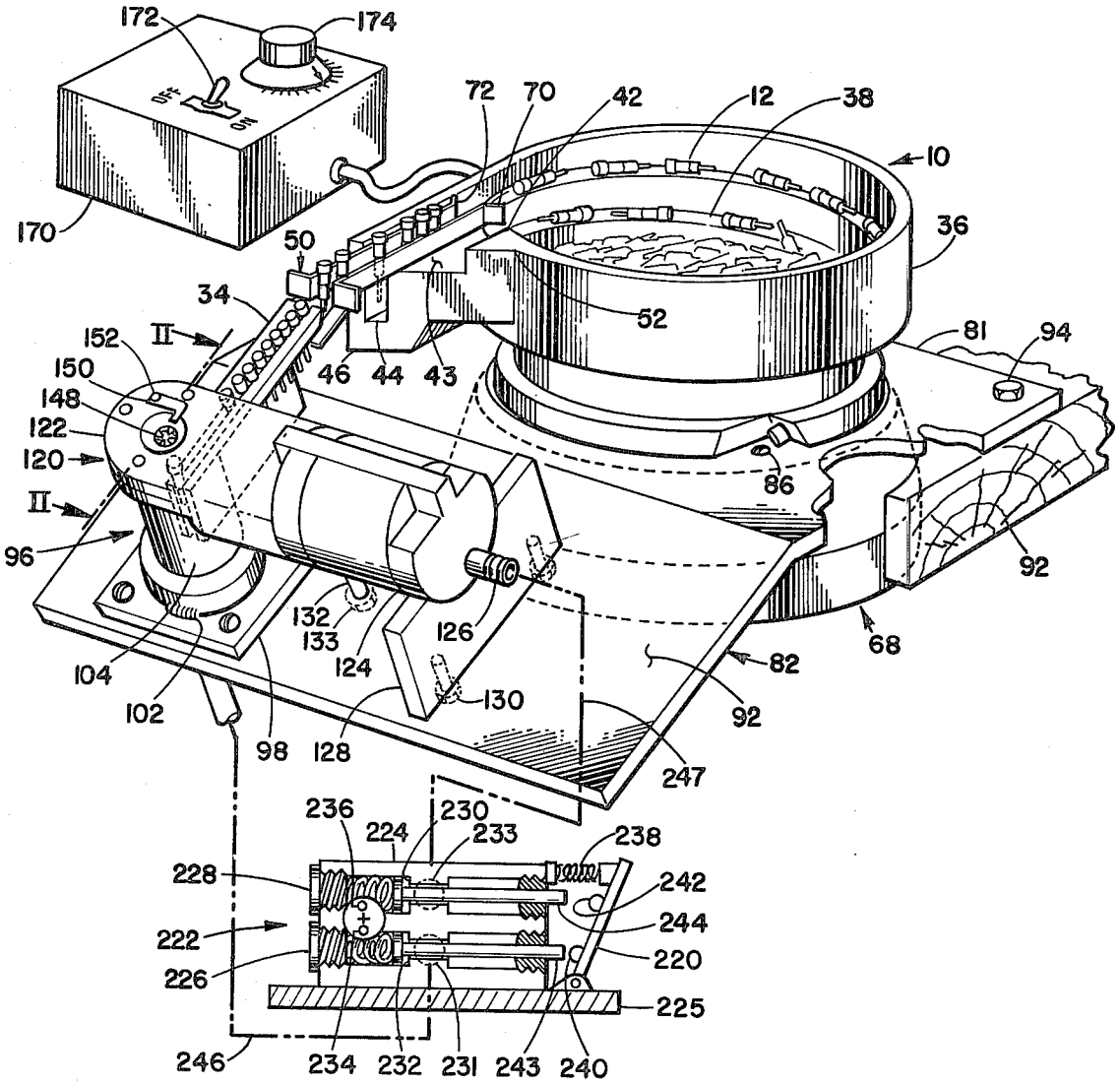
FIG. 1 is a perspective view of the hopper, feeding tracks, and crimping mechanism, also showing in diagrammatic form the pneumatic control system for the feeder and the crimping mechanism.

Referring to FIG. 1, an annular hopper 10 is provided for receiving a plurality of elongated structures 12, which in the present embodiment comprise electrical contacts 12 as shown most clearly in FIG. 6. Referring additionally to FIG. 6, the electrical contact 12 is of the type having a ferrule head 14 and an elongated portion 16 of smaller diameter than the head portion and having a distal end 18 spaced from the ferrule head 14. The ferrule head portion 14 has an open end 20 spaced from the elongated portion 16 for receiving an uninsulated portion of an electrical wire 22, as shown in FIG. 5, for permitting crimping of the head portion 14 onto the electrical wire during crimping operations. The electrical contact 12, in the embodiment of FIGS. 1 and 6, includes upper and lower annular support surfaces 24 and 26 defined by annular, raised portions 28, 30 of the ferrule head portion 14 which extend peripherally of the head portion, the support surfaces 24 and 26 facing in the direction, along the length of the electrical contact 12, toward the elongated portion 16. The center of gravity of the electrical contact 12 is spaced below the lower support surface 26; that is, spaced between the support surface 26 and the distal end 18 of the elongated portion 16, which permits the electrical contact 12 to remain upright when the support surfaces 24 or 26 are engaged by one of first and second, vibratory tracks 32, 34 to be described. In the illustrated embodiment, the electrical contact 12 is a male plug in which the elongated portion 16 is a solid pin; in another embodiment, not shown, the elongated portion is a jack, it being only necessary that the outer diameter of the jack be less than that of the support surfaces 24 and 26.

Referring now to FIGS. 1 and 2, the annular hopper 10 is of a type commonly used in the article handling art, having a peripheral sidewall 36 and a spiral pathway 38 extending upwardly from the floor 40 (FIG. 2) of the hopper to the sidewall, an outlet 42 being formed through the sidewall tangentially of the hopper 10 in register with an upper portion of the spiral pathway 38 for receiving electrical contacts 12 which are passed upwardly along the spiral pathway 38.

Figure 3:
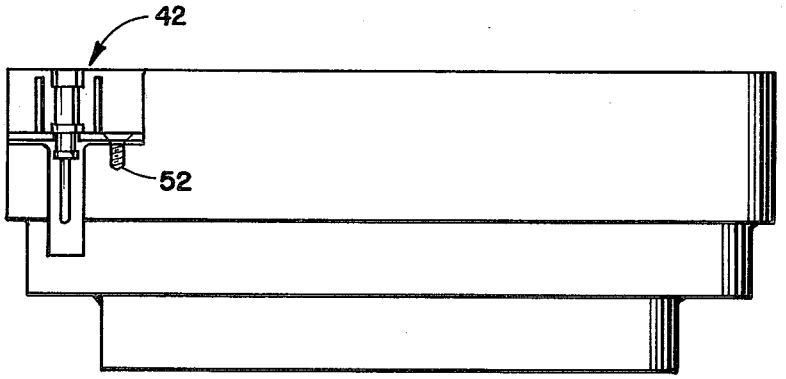
FIG. 3 is a cross-sectional view of the first track taken as on line III—III of FIG. 2 and showing a portion of the annular hopper.

Means for orienting the electrical contacts 12 subsequent to their discharge from the hopper 10 are provided in conjunction with a discharge trough 44 defined by a discharge housing 46 which is affixed, as by welding, to the outer surface of the sidewall 36 adjacent the discharge opening 42 and with the discharge trough 44 extending tangentially of the sidewall 36 in register with the discharge opening 42. The discharge housing 46 has an upper surface 48 which extends generally horizontally, and the first track structure 32 is fastened downwardly upon the upper surface 48, suitably by screws 52, as shown more clearly in FIGS. 3 and 4. The first track structure 32 includes a horizontally extending portion comprising first and second, parallel strips 54, 56 which are continuous with, and connected through, a curved, entrance portion 58, the entrance surface 58 extending in approximate alignment with the surface of the adjacent portion of the spiral pathway 38 for receiving the electrical contacts 12 as they are discharged from the hopper 10. As shown in FIG. 4, the curved, entrance surface 58 defines, at its inner edge, a concave, arcuate cutout portion 60 which faces a linear cutout area or pathway 62 formed between the first and second strips 54, 56. Vertical guide strips 64, 66 are affixed to the horizontal, first and second strips 54, 56 and extend alongside the linear pathway 62. The vertical strips 64, 66 are mutually parallel, and are equally spaced from the linear pathway 62 to permit passage therebetween of the electrical contacts 12, as shown more clearly in FIG. 3 and as will be described in detail below. End portions 70 and 72 of the vertical strips 64, 66 which extend over the arcuate entrance portion 58 are mutually outwardly curved to form a diverging entryway for directing the electrical contacts 12 onto the first track 32 and for orienting the contacts in alignment with the linear pathway 62. As will be understood from the description below of the vibratory unit 68, the hopper 10 (along with its discharge housing 46 and the track structure 32) is caused, in operation, to vibrate in a circular vibratory motion which causes the electrical contacts to pass upwardly along the track 38, according to principles well known in the art, and to subsequently enter the space defined between the divergently curved portions 70, 72 of the vertical strips 64, 66.

As is the usual practice in the art, the spiral pathway 38 is, in cross-sectional configuration, sloped somewhat downwardly in the radially outward direction; that is, toward the hopper sidewall 36, so that the electrical contacts 12 tend to follow the pathway 38 alongside the sidewall portion 36. During my experimentation, however, it has been found to be advantageous, when the electrical contacts 12 are plugs rather than jacks, to machine a final surface portion 73 which slopes in the opposite direction; i.e., having a downward inclination toward the hopper floor 40. The reason for this is that in the case of electrical plugs having relatively narrow, elongated pins 16, the pins may in some cases become lodged coaxially within the open ferrule head portion 14 of an adjacent electrical contact 12 (as shown at 12*a* in FIG. 4) and, absent the inwardly sloped area 73, pass through the guide walls 64, 66 while thus interconnected. This is undesirable in that the longitudinal portion 16 of the pins then are not free to extend downwardly within the orienting track section defined between the vertical strips 64, 66, and they then slow the delivery of contacts along the track before dropping off the end of the first track, and occasionally may tend to obstruct the track 32 or the orienting section extending between the strips 64, 66.

The inwardly and downwardly sloped area 73, shown in FIG. 4, is that portion extending radially inwardly from a crest or ridge 74. The ridge 74 extends from the entrance surface 58 and generally longitudinally of the spiral pathway 38, for a distance somewhat greater than the length of a single electrical contact 12 but less than that of two contacts which have become telescopically engaged as shown at 12*a*. To enhance the diverting action of the surface 73, the sidewall 36 has an inwardly raised surface 75 defined suitably by a small weldment applied on the inner surface of the sidewall 36, to divert double contacts inwardly over the crest 74 and onto the hopper floor, but to permit single contacts 12 to pass over an adjacent, outwardly sloped portion 76 and between the diverged wall portions 70, 72. Satisfactory results have been obtained with an inwardly sloped area 73 having a downward inclination of apwithin an internally threaded bore formed a short distance upwardly within the body portion 124. The mounting bolt 132 includes a lock washer and head 133 positioned beneath the inclined portion 90 of the vibratory support unit 82, whereby the bolt 132 may be tightened to bring the crimping mechanism 122 into firm contact with both the vertical mounting plate 128 and the cylindrical housing 104 of the feeding apparatus 96.

As shown in FIG. 5, the crimping head 122 includes a converging opening 134 defining its lower, feeding entrance, and, as has been noted, the upper, central surface of the cylindrical housing 104 is raised to form a mating, converging boss 118 through which the bore portion 112 extends coaxially toward the converging opening 134 of the crimping tool 120. This facilitates the centering of the head portion 122 of the crimping tool 120 over the cylindrical housing 96 and facilitates mutual aligning of the feeding bore 112 with the entrance 134 to the crimping tool head 122. The construction of such crimping mechanisms 120 is known in the art, and will not be described in detail herein. In summary, however, and referring to the diagrammatic representation of the crimping head 122 in FIG. 5, it will be recognized by those in the art that there is defined above the inlet 134 a crimping chamber 142 adapted to receive the ferrule head portion 14 of an electrical contact 12, and indentor members 144 movably positioned within an annular cam structure 146. In operation, the cam structure 146 is rotatably displaced by air pressure received through the inlet 126 (FIG. 1) of the crimping machine 120 for causing the indentor members 144 to crimp the ferrule head portion 14 onto the stripped end of a wire 22, which is manually inserted downwardly therein through the crimping head outlet 148.

While such crimping apparatus are known in the art, a catch mechanism 150 is desirably added in the present application to prevent premature ejection of the contacts 12 during feeding, as will be understood from the description hereinbelow of the operation of the feeding apparatus 96. The catch or stop member 150 is preferably of L-shaped construction (as best seen in FIG. 1), and is adjustably fastened to the top surface of the crimping mechanism head portion 122 by means of a screw 152 or other suitable, adjustable fastening means, the screw being spaced from a small, projecting leg portion 154 of the member 150 which portion 154 has a distal end extending over the outlet 148 sufficiently far to extend over the peripheral wall of the ferrule head 14 of an electrical contact 12, but not substantially far to cover the cylindrical cavity formed therein. This permits an operator to insert conveniently the wire 22 into the ferrule head portion 14 of the contact 12 while at the same time preventing undesirable ejection of the contact 12, yet permits the operator to conveniently remove the contact 12 subsequent to the crimping operation by merely pulling the contact laterally, away from the distal end of the leg portion 154 and out of the crimping chamber 142, there being a slight degree of play in the chamber when the crimping indentors 144 are withdrawn.

It will be seen from the above and following sections that one of the advantages of the present apparatus is that a commercially available crimping tool 120 may be conveniently and advantageously employed, the mounting plate 128 and the upper surfaces of the cylindrical housing 104 being readily configured to accommodate various commercially available crimping tools.

Continuing now the description of the feeding apparatus 96, with primary reference to FIG. 5, the first, second, and third, i.e., upper, middle, and lower portions 112, 114, 116 of the vertical passageway 110 extending through the cylindrical housing 104 are coaxially aligned bores of progressively increasing diameters. The lower portion 116 is internally threaded; threadingly engaged therein is an externally threaded cylindrical member 156, also having a central, longitudinal passageway comprising a lower bore 158 (which itself is internally threaded at its upper end as shown at 160) communicating with an upper bore 162, which has a diameter substantially equal to that of the mid-portion 114 of the channel 112 through the cylindrical housing 104. Within the bores 162 and 160 is mounted a pneumatically operable plunger mechanism 164, comprising a cylindrical, tubular housing portion 166 having upper and lower, transversely extending endwalls 170 and 168, both having openings, not enumerated, formed centrally therethrough, respectively. Rigidly connected to and beneath the outer surface of the lower end wall 168 is an externally threaded cylindrical member 172, the member 172 also having a central, longitudinally extending bore 174 extending therethrough and communicating with the opening which extends through the lower end wall 168. Reciprocally and slideably mounted within the cylindrical tube portion 166 is a piston member 176 rigidly and coaxially affixed to a piston rod 178 which extends upwardly through the opening defined through the upper endwall 170 and toward the uppermost feeding bore portion 112 of the channel 110. The piston member 176 and piston rod 178 are normally maintained in a retracted position, as shown in FIG. 5, by a coiled spring 180 footed under pressure between the upper and lower end walls 170, 168 of the tubular member 166.

The externally threaded portion 172 of the plunger mechanism 164 is tightly threaded within the lower bore 158 of the externally threaded cylindrical member 156 until the lower end wall 168 of the tubular member is brought into rigid contact with a seat 182 or step extending radially between the lower bore 158 and the upper bore 162. Vertical adjustment of the tubular member 168 within the cylindrical housing 104 is accomplished by rotation of the outwardly threaded cylindrical member 156 within the third channel portion 116, the housing 104 being fixed in position by tightening a large nut 184 down upon the projecting end thereof and against the base plate 98, or if desired for additional structural strength, against the inclined portion 90 of the vibratory support means. The uppermost end of the piston rod 178 is rigidly and coaxially connected to a seat unit 186 of generally cylindrical construction. The seat unit 186 is of a diameter slightly smaller than that of the feeding bore 112 and is therefore adapted to slide vertically within the channel 112 for feeding the electrical contacts 12 into the crimping chamber 142 of the crimping mechanism 120. In the case of a male electrical contact 12, as illustrated in the present embodiment, the upper surface 188 of the seat unit 186 is of concave cross-sectional configuration, whereby the distal end 18 of the contact 12 is caused to center itself within the seating surface 188.

With continued reference to FIG. 5, a cutout portion 190, of rectangular cross-section, extends laterally within the cylindrical housing 104, from its side portion facing toward the first track 32, to a location spaced beyond the feeding bore 112. Within the cutout portion proximately 17 degrees. The crest 74 is spaced inwardly from the raised surface 75 adjacent the entrance surface 58 and, at its other end, from the sidewall 36, by a distance approximately equal to the diameter of one of the contacts 12, for permitting single contacts 12 to remain on the pathway 38 as they pass alongside the inwardly inclined surface 73.

The first and second strips 54, 56 extend beyond the vertical strips 64, 66 and, as seen more clearly in FIG. 2, the extending portion has a downward inclination, which is insufficient to permit sliding movement therealong of the electrical contracts 12 absent vibratory movement of the tracks, but which enhances movement of the contacts 12 along the tracks when the hopper 10 is caused to vibrate by the vibrating unit 68. A downward inclination of about 15 degrees has been employed successfully. The first and second strips 54, 56 thus define a first track 32 structure having, at its distal end portion, a downward inclination, the first and second parallel strips 54, 56 thus constituting parallel rails which are spaced apart to engage mutually opposite portions of the lower support surfaces 26 of the electrical contacts 12. The first track 32 has a proximate end portion connected to the hopper 10 adjacent the hopper outlet 42 and extending tangentially from the outlet for serially discharging the contacts 12.

Referring to FIG. 2, the annular hopper 10 is mounted upon the vibrating unit 78 of the vibrator 68 by means of a centrally located, vertically extending shaft 80 which is bolted to the base of the annular hopper bowl 10. The vibrator unit 68 is suitably of the type manufactured by Automatic Devices, Inc. of Fairview, Pennsylvania as VFC Model 5. The vibrator 68 has been modified by the addition of an annular spacing ring 81 which is rigidly mounted to the hopper 10 above a vibratory support 82, as will be described. The vibrating unit 68 also incorporates an annular base 84, of generally cup-shaped configuration, and the vibratory support unit 82 is mounted upon the uppermost edge portion of the annular base 84 by means of metal screws 86, as also shown in FIG. 1. The vibratory support unit 82, as can be seen in FIG. 2, has a generally horizontal portion 88, in the center of which the vibrator unit 68 is mounted, and an inclined portion which extends downwardly approximately parallel to the downwardly inclined portion of the first track 32. The entire vibrator unit 68 and hopper 10 are preferably mounted to a grounded support such as a table, as represented at 92, by means of bolts 94 fastened through the horizontal portion 88 of the vibratory support unit 82 and through the table or other support structure 92. The vibratory support unit 82 is preferably fastened to the table or other support structure 92 at a position spaced beyond the vibratory unit 68 from the inclined portion 90, with the support unit 92 extending beneath the vibratory support portion 88 for a distance of about half the length of the horizontal support portion 88. As a result of my experiments, I have found that this particular mounting technique increases the transmission of vibratory movement along the length of the vibratory support unit 82 and enhances the passage of the electrical contacts 12 along the second track 34, for reasons which will become more apparent in the description hereinbelow of the operation of the system. In fact, the discovery of this effect resulted from my experimentation in which originally the vibratory support unit 82 was also bolted to the table 92 on the side opposite the bolts 94, adjacent the inclined portion 90, and it was discovered that movement of the electrical contacts 12 along the second track 34 was significantly expedited by a removal of those additional bolts (not shown).

Referring now to FIG. 5 primarily and with secondary reference to FIG. 1, an electrical contact feeding apparatus 96 is also mounted on the vibratory support unit 82. As seen in FIG. 1, the feeding apparatus 96 is mounted upon a base plate 98 which is bolted to the inclined portion 90 of the vibratory support unit 82 by means of a collar 100 which is welded, as at 102, to the base plate 98, the feeding apparatus 96 having a cylindrical housing 104 which extends coaxially within the collar 100 and rests upon the base plate 98. Collar 100 is in the form of a divided clamp having, at its base portion opposite the weldment 102, dual projecting legs or tabs 106 (FIG. 5) extending radially from the housing 104, adjacent and normally slightly spaced one from the other, whereby the collar 100 may be drawn into rigid contact with the cylindrical housing 104 by tightening a bolt 108 extending horizontally, transversely, through the two legs 106, upon a nut, not shown. Alternatively, the cylindrical housing 104 may be fastened upon the vibratory support unit 82 by direct welding thereof to the base plate if desired, or by other means. Formed centrally and longitudinally through the cylindrical housing 104 is a channel 110 opening at both ends of the housing 104. The channel 110 includes first, second, and third successive, mutually coaxial portions 112, 114, and 116. The first, uppermost portion 112, termed the feeding bore 112, is in the form of a bore opening through the upper surface of the cylindrical housing 104 and extending downwardly therefrom coaxially within the cylindrical housing 104. The first, upper channel portion 112 (feeding bore 112) has an inner diameter slightly larger than the outside diameter of the electrical contacts 12 for permitting longitudinal, axial movement of the contacts upwardly toward a raised, outlet portion 118 of the cylindrical housing 104. Positioned immediately above the cylindrical housing 104 is a crimping mechanism 120, suitably of a type manufactured by the Daniels Manufacturing Corporation, of Pontiac, Mich., as Model 27V.

Referring additionally to FIG. 1, the crimping mechanism 120 has a generally planar head portion 122, which is also seen, in cross-sectional, partially diagrammatic representation in FIG. 5, and an elongated, cylindrical body portion 124 (FIG. 1) which is provided at its end opposite the head 122 with an air inlet 126 for receiving air under pressure to actuate the crimping mechanism. The crimping mechanism 120 is rigidly affixed atop the cylindrical housing 104 of the feeding apparatus 96 in a position in which its head portion 122, which is of generally semi-cylindrical configuration in plan, is centered above the cylindrical housing 104 and seated thereon, extending in a plane perpendicular of the housing 104. The opposite end of the crimping mechanism 120 is suitably seated (FIG. 1) within a semi-cylindrical cutout portion of a vertical mounting plate 128, which is rigidly affixed to the inclined portion 90 of the vibratory support unit 82 as by means of vertically extending bolts 130; or by other suitable means. While it is feasible to bolt or otherwise attach the crimping mechanism 120 down at both its end portions, it has been found convenient to employ a single bolt 132, extended upwardly, perpendicularly through the inclined portion 90 of the vibratory support unit 82 toward a mid portion of the cylindrical body 124 of the crimping mechanism 120 and threadingly engaged 190 is fitted a rectangular, enlarged portion 192 of an elongated support structure 194 upon which are mounted first and second rails 196, 198, which rails define the second track 34. The elongated support structure 194 is of approximately U-shaped cross-sectional configuration, having a planar, lower portion 200, and the first and second rails 196, 198 are suitably braided, as shown at 202, downwardly to the tops of the sidewalls of the support structure 194 and extend longitudinally thereof. The first and second rails 196, 198 are spaced apart sufficiently to permit entrance therebetween of the ferrule head portions 14 of the electrical contacts (FIG. 6) but having a gauge sufficiently narrow that the upper support surfaces 24 of the electrical contacts 12 are able to seat, loosely, upon the upper, centrally facing edges of the rails 196, 198. The centrally facing edges (not enumerated) of the rails 196, 198 are inwardly sloped toward their uppermost surfaces, as are the strips 54, 56, as shown in FIG. 6. The contacts 12 may also include a spring clip 31, in the form of a divided ferrule, for locking the pin member 16 within a jack unit not shown, as is common in the art. The clip member 31 is also of smaller diameter than the surfaces 24, 26 and the track gages. As seen more clearly in FIGS. 6 and 7, the proximate end portions 204, 206 of the first and second rails 196, 198, i.e., the ends adjacent the rectangular portion 192, are of a reduced width whereby they may be extended within the rectangular portion 192 of the elongated support structure 194 whereby the rectangular portion 192 is not of decreased rigidity and strength by reason of its being divided by the full width of the rails 196, 198. The reduced end portions 204, 206 extend within the rectangular portion 192 to a vertical plane tangential of a vertically formed bore which defines a feeding chamber 208. The feeding chamber 208, as seen more clearly in FIG. 5, is configured to communicate coaxially with the feeding bore 112 the first, upper portion 112 of the channel 110) in the cylindrical housing 104. A bolt 210 is extended through a bore formed transversely within the cylindrical housing 104 and extending perpendicularly toward the region of the rectangular portion 192 which extends beyond the bore 112; the bolt 210 is threadingly engaged with the rectangular portion 192 to rigidly seat the elongated support structure 194 within the cylindrical housing 104.

With continued reference to FIG. 5, piston rod 178 is of a length sufficient, relative to the positioning of the outwardly threaded cylindrical member 156, that the concave seating surface 188 is positioned within the feeding chamber 208 upon the piston structure being in its retracted position, i.e., urged downwardly by the spring 180 into contact with the lower endwall 170. In this retracted position, an electrical contact 12 seated atop the concave seating surface 188 is positioned slightly below any laterally adjacent contact 12 which is riding upon the first and second rails 196, 198 of second track 34, in order that a single contact 12 will be stripped from the track 34. The piston rod 178 is of sufficient length that, upon the piston member 176 and piston rod 178 being raised until the piston rod is extended to a fully projected position, in which the piston unit 176 is stopped by the upper end wall 168 of the tubular housing 166, an electrical contact 12 seated upon the concave seating surface 188 will have been thrust upwardly into the crimping tool 120, its ferrule head portion seated within the crimping chamber 142 and in alignment with the indentor members 144. As has been suggested, the crimping tool 120 is shown merely in diagrammatic form, and other configurations and types having mutually oppositely facing inlets (134) and outlets (148) may be employed.

The elongated support structure 194 is supported at a midportion thereof by a vertical standard 212, which is ridigly affixed to the base plate 98 as by welding or other means, and which extends upwardly for supporting the elongated support structure 194. In cross-section, and as shown more clearly in FIG. 7, the vertical standard 212 has a rectangular cutout 214 formed centrally downwardly from its upper surface, the cutout portion 214 being of an appropriate width and height for snugly receiving the elongated support structure 194. The standard 212 is of appropriate length to position the elongated support structure 194 with the second track structure 34 extending approximately parallel to and slightly above the inclined portion by the first track structure 32, i.e., having an inclination downwardly toward the feeding mechanism 96. As seen most clearly in FIG. 4, the distal end of the second track structure 34 extends over the distal end of the first track 32. As shown in FIG. 4, the centrally facing edges of the first and second rails 196, 198 diverge outwardly to receive contacts 12 which are riding down the first track 32. However, a non-diverged portion 171 of the second track 34 is also preferably extended over the first track 32, for reasons which will become apparent from the description of the operation of the apparatus hereinbelow.

Referring to FIG. 1, the vibrator unit 68 is powered by a control unit 170, suitably an SCR unit as manufactured by Automatic Devices, Inc. and as provided with the above-discussed, Daniels vibrator unit 68. The control unit 170 has a power switch 172 and a rotary control 174 for permitting adjustment of the intensity of vibration. Because these components are commercially available, they are not described in detail herein.

In operation, the hopper 10 is loaded with a quantity of the electrical contacts 12 and the switch 172 is positioned in an "on" position to conduct power to the vibrating portion 78 (FIG. 2) of the vibrator 68. According to practices known in the art, vibratory movement in a rotary direction about the axis of shaft 80 is induced into the hopper 10 through the shaft 80 and a spacer element 218 to the hopper bowl 10 to cause the electrical contacts 12 to climb the spiral pathway 38 toward the discharge outlet 42. The control 174 is preferably adjusted by an operator to permit discharge of the electrical contacts through the outlet 42 at a rate sufficient to maintain a continuous, serial flow of the contacts 12 toward the feeding apparatus 96.

Referring to FIGS. 2 and 4, the clips 12 enter the area between the diverging portions 70, 72 of the vertical guide strips 64, 66 longitudinally in either orientation, that is, with either the ferrule 14 or the elongated portion 16 leading. If the control 174 is set sufficiently low to prevent excessive "bunching" or overriding of the clips, they will generally follow the hopper side wall 36, longitudinally spaced one behind the other (as shown in FIG. 1). The inwardly curved surface 75 (FIG. 4) of the weldment will then, as has been discussed previously, divert single ones of the electrical contacts into the channel between the upright guides 66, 64 whereupon, as shown in FIG. 2, the clips are then passed serially into the linear pathway 62. In cases in which the clips have become longitudinally engaged (12*a*, FIG. 4), as previously discussed, the radially inwardly sloped surface 73 of the spiral pathway 38 will divert the mutually joined contacts inwardly into the hopper, in most instances.

As seen most clearly in FIG. 2, the elongated portion 16 of the clips 13, being narrower than the gage of the first track structure 32, will then drop between the first and second strips 54, 56 (FIG. 4) into the trough 44. Vertical orientation and mutual alignment of the electrical contacts 12 in the horizontal portion of the first track structure 32 is also enhanced by the vertical guide strips 64, 66, which prevent excessive lateral deflection of the contacts and serve to guide the contacts into an orderly, serial progression.

The partially circular vibratory movement of the hopper 10 causes vibratory, predominantly lateral motion to be transmitted to the first track 32 to cause the contacts to pass horizontally, along the horizontal portion, and then downwardly along the inclined portion of the first track structure 32. Because the track 32 is not inclined so substantially as to cause slideable movement of the contacts absent vibratory movement thereof, the contacts remain in an upright position as they move downwardly and from side to side as the track 32 vibrates, toward the second track 34. As the contacts 12 enter the diverging inlet portion of the second track 34, their lateral vibration relative to the first track 32 is transferred to the second track 34. Particularly in the case of the contacts 12, illustrated in the present embodiment, having upper and lower peripheral support surfaces 24, 26 wherein the second surface 26 rides upon the first track 32, a large degree of kinetic energy is transferred from the first to the second track. This is because the center of gravity of a respective contact 12 is fairly near the second surface 26, rather than being spaced therefrom substantially as in the case of a contact having a single, upper support surface 24, so that the contact 12 tends to sustain a larger degree of lateral vibratory movement than would be the case if vibration were induced only through the upper surface 24, wherein the contact 12 would instead tend to swing laterally from side to side as its predominant motion and wherein the lower portions of the contact would not then be forced to move laterally other than through largely pendulous movement thereof. In the case of a contact, not shown, having merely a single support surface (24), the first track 32 is arranged to extend over the second track, whereby the contacts 12 drop off the distal ends of the first track 32 onto the second track 34.

Referring now to FIGS. 2 and 5, in the present embodiment, ferrule head portions 14 of the contacts 12 then ride between the rails 196, 198 of the second track 34 and, upon the contacts reaching the distal end of the first track 32, the contacts fall into a position in which the first support surfaces 24 (FIG. 6) ride upon the second track 34. Because of vibratory motion transmitted to the second track structure 34 through any contacts 12 which are in vertical alignment with both the first and second track structures 23, 34, and because of vibratory motion transmitted through the vibratory support unit 82, through the upright standard 138, to the second track 34, contacts 12 riding upon the second track structure 34 are caused to pass downwardly along the second track 34, remaining in an upright position. In my experiments, both of these effects have been demonstrated. That is, it has been observed, as has been mentioned previously, that a definite enhancement of movement of the contacts along the second track 34 is obtained through the vibratory support unit 82, which, as has been illustrated, is in the form of an elongated, metal sheet, in the present embodiment, having portions 88 and 90. As discussed previously, it was demonstrated that this effect is increased when the support unit 82 is rigidly mounted at only one end, opposite the inclined portion 90. It has also been demonstrated that movement of the contacts 12 along the second track is even more substantially enhanced by vibratory movement passed through the contacts 12 in vertical alignment with both tracks 32, 34. This has been demonstrated by tests in which single contacts 12, positioned non-movably upon the second track 34 and spaced from the rails or strips of first track 32, remain stationary when vibration of the hopper 10 is not sufficient to cause movement of the contacts 12 along the second track 34 merely by vibration transmitted thorugh the vibratory support unit 82. As contacts 12 are then permitted to move downwardly along the first track 32 until they become in vertical alignment with both the track structures 32, 34, the second track 34 is seen to vibrate from the transferral of vibratory motion through the contacts 12 in the region of superimposition of the second track structure 34, and the contact 12 which was positioned on the second track 34 is seen to begin downward movement toward the feeder 96. This movement does not depend upon physical contact with the other electrical contacts 12. However, in continuous operation of the apparatus, the contacts 12 will normally pass in mutual contact one with the other for further enhancing orderly, upright movement along the tracks 32, 34 as shown in FIG. 1.

Referring now to FIG. 5, upon the contacts 12 reaching the loading chamber 208 of the feeding apparatus 96, one of the contacts falls off the end of the second track 34 as shown in FIG. 5, and its elongated pin portion 16 is centered within the concave seating surface 188. The plunger unit 164 is then energized by the application of air under pressure by the movement of a foot pedal 220, of a dual, valving unit 222.

Referring to FIG. 1, wherein the dual valving unit 222 is shown in partially diagrammatic form, an elongated housing 224 is mounted upon a base 226 upon which the foot pedal 220 is pivotally mounted at one end of the housing 224. First and second, spring loaded piston structures 226, 228 are reciprocally mounted in corresponding chambers, not enumerated, and have seals which seat against first and second valve seats 230, 232. The seats communicate with outlets 231, 233. First and second air inlets 234, 236 communicate with a source of air under pressure, not shown, and communicate respectively with the chambers in which the first and second piston structures 226, 228 are mounted. The foot pedal 220 includes seats 240, 242 which are positioned to contact a projecting end 243 of the first piston structure 226 before contacting an end portion 244 of the second piston structure.

Accordingly, upon the foot pedal 220 being depressed to contact the end 242 of the first piston structure 226, the first piston structure is moved from contact with the seat 232 before the second piston structure 228 is moved. Because the piston structures 226, 228 are not in sealing relation to the piston walls, air under pressure is then permitted to pass around the piston unit of the first piston structure 226, through the first valve seat 232 through the associated chamber and through the first outlet 231. A conduit 246 is provided in communication between the outlet 231 and a suitable fitting 248

(FIG. 5) communicating with the lower bore portion 160 of the feeding mechanism 96.

Because the bores 158 and 174 communicate with the plunger chamber 162, the piston 176 and piston rod 178 are then driven upwardly, driving the contact 12 seated on the surface 188 upwardly through the feeding chamber 208 and the feeding bore 112 and into the crimping tool 120, with the ferrule head portion 14 then being positioned within the crimping chamber 142 in alignment with indentor units 144 upon the piston rod being in its fully projected position, as previously discussed.

It will be noted because of the linear and orderly passage of the contacts 12, which results from the use of vibratory movement rather than a predominantly gravity-induced movement, the contacts 12 do not undergo any substantial degree of change in orientation once they exit the hopper 10 and assume the upright position. It has thus been found that transfer of the contacts from the hopper to the second track, and feeding of the contacts into the chamber 142 of the crimping unit 120, is accomplished with a minimum degree of stoppages or malfunctions.

Because of the provision of the stop member 150 upon the head of the crimping tool 120, the contacts 12 remain in the chamber 142 adjacent the indentors 144, and are not projected outwardly from the crimping machine. (As a result of momentum and air pressure from piston 186.) The stop member 150 also permits convenient insertion of the bare end of an electrical wire 22 into the open, ferrule end portion 14 of the contact 12, according to the general usage of such crimping machines.

Further movement of the foot pedal, to a second position, similarly opens the second valve unit 228 and causes air under pressure to be passed to the inlet 126 of the crimping machine 120, causing rotary movement of the member 146 to crimp the electrical contact 12 onto the wire 22. Subsequently, the operator may conveniently withdraw the crimped contact 12 from the crimping chamber 142 by merely pulling the wire 22 in a direction away from the distal end portion of the catch member 150, there being a degree of lateral play in the crimping chamber 142 when the indentors 144 are withdrawn. The convenience afforded by the dual valving mechanism 222 is an important element in providing increased output rates, in that the operator need not look away from the machine during either the feeding or crimping operations.

As has been previously mentioned, the problem of jams induced by the passage of contacts **12*a* which are telescopically mutually interconnected, and which thus would not assume an upright position upon the tracks, is largely solved by the provision of the inwardly sloped surface 73, and by the spacing of the first track 32 below the second track 34, whereby interconnected contacts 12*a* will merely fall off the distal end of the first track 32 should they occasionally pass the diverting surface 73**.

It will thus be seen that, because of the transmission of vibratory motion from the first to the second track structures 32, 34 and, secondarily, through the vibratory support unit 82 and through the physical contacts of contacts which are arranged side by side during normal operations shown in FIG. 1, a smooth, continuous flow of the contacts on both tracks and into the feeding mechanism 96 is achieved. The feeding mechanism 96 may therefore be of substantially simpler construction than prior-art devices in which rather complex gripping and contact handling arms and levers are required. It will be noted that very few moving parts are employed in both the feeding and the contact transferring structures. A further advantage of the present system is that it is conveniently employed with existing, commercially available and highly perfected crimping units 120, as has been described.

While only one embodiment of the invention, together with modifications thereof, has been described in detail herein and shown in the accompanying drawing, it will be evident that various further modifications are possible in the arrangement and construction of its components without departing from the scope of the invention.

I claim:

1. A crimping machine for serially advancing, feeding, and crimping electrical contacts of a type having a ferrule head portion and an elongated portion of smaller diameter than the head portion, the head portion defining upper and lower, peripherally extending support surfaces adjacent its periphery and facing the elongated portion, the center of gravity of the contacts lying between the lower support surface and the distal end of the elongated portion, the apparatus comprising:

an annular hopper having a peripheral sidewall portion and a spiral pathway extending upwardly from the floor of the hopper to the sidewall, an outlet being formed through the sidewall adjacent and communicating with the spiral pathway;

a first track structure, having first and second parallel rails spaced apart to engage mutually opposite portions of the lower support surfaces of the electrical contacts, the first track having a proximate end portion connected to the hopper adjacent the outlet and extending, substantially horizontally, tangentially from the outlet, and a second portion having a downward inclination which is insufficient to permit sliding movement of the contacts therealong absent vibratory movement of the track structure, the first track structure comprising a means for slideably engaging the lower, contact support surfaces on opposite sides of the contacts and for permitting movement therealong in response to vibration of the first track structure;

vibratory means connected to the hopper for inducing vibratory movement of the hopper and of the first track structure for causing electrical contacts within the hopper to pass upwardly along the spiral pathway, through the hopper outlet, and along the horizontal and inclined portions of the first track structure with the lower support surfaces of the contacts seated upon the first and second parallel rails and their elongated portions extending substantially vertically downwardly between the first and second rails;

a crimping mechanism, having means for crimping the ferrule head portions of the contacts onto electrical wires inserted into the head portions;

feeding means for receiving the contacts and for sequentially feeding the electrical contacts into the crimping mechanism, the feeding means having an opening for receiving contacts to be fed to the crimping mechanism, and comprising a means for receiving the contacts in a substantially upright position and for imparting a longitudinal motion to the contacts as they are fed to the crimping mechanism;

a second track structure extending substantially parallel to the inclined portion of the first track structure and extending partially over the first track structure, the second track structure comprising a means for receiving contacts from the first track structure, for engaging the upper support surfaces of the contacts, and for serially passing the contacts through the opening of the feeding means; and resonantly vibratory support means connected to the vibratory means, the feeding means and second track structure being mounted on the vibratory support means, the vibratory support means comprising means for supporting the second track structure in alignment with the first track structure, and for orienting the second track structure with an inclination insufficient to permit sliding motion therealong of the contacts, the vibratory support means comprising means for inducing vibration of the second track structure for enhancing movement of the contacts therealong, the first and second track structures having respective distal end portions, in vertical alignment, which comprise means for transferring vibratory motion from the first to the second track structures through any electrical contacts which are vertically aligned with both the first and second track structures.

2. The apparatus of claim 1, the resonantly vibratory means comprising a metal plate connected to and extending from a portion of the hopper to the feeding means.

3. The apparatus of claim 1, the feeding means having a plunger mechanism positioned beneath the receiving chamber, the plunger being movable to urge the contacts from the receiving chamber into the crimping chamber, and an air supply means for urging the plunger upward into the receiving chamber of the crimping machine and for actuating the crimping machine to crimp the ferrule of the particular contact.

4. The apparatus of claim 2, further comprising a two-position foot pedal valve having a first position capable of transmitting air pressure to the feeder, and a second position adapted to transmit air pressure to the feeder and the crimper.

5. A crimping machine for serially advancing electrical contacts of a type having a ferrule head portion and an elongated portion of smaller diameter than the head portion, the head portion of each contact defining upper and lower support surfaces, adjacent its periphery facing the elongated portion, the center of gravity of the contact lying between the lower support surface and the distal end of the elongated portion, the apparatus being adapted for advancing and feeding the electrical contacts into a crimping tool, the apparatus comprising:

an annular hopper of the type having a peripheral sidewall portion and a spiral pathway extending upwardly from the floor of the hopper to the sidewall, an outlet being formed through the sidewall adjacent the spiral pathway;

a first track structure extending tangentially from the annular hopper and having communication with the outlet, the first track structure having a portion having a downward inclination which is insufficient to permit sliding movement of the contacts without vibratory movement of the track and comprising means for vertically orienting the contacts, for engaging the lower support surfaces thereof, and for translating the contacts therealong from the hopper outlet upon receiving vibratory movement from the hopper;

vibratory means connected to the hopper for inducing vibratory movement of the hopper and of the first track structure for causing contacts within the hopper to pass along the spiral pathway, through the outlet, and along the first track structure;

feeding means, having an inlet opening for receiving the contacts, comprising means for sequentially feeding the electrical contacts into the crimping mechanism;

a second track structure extending parallel to the inclined portion of the first track structure and having a portion in vertical alignment with a portion of the first track structure, the second track structure comprising a means for receiving contacts from the first track structure and for serially passing the contacts through the inlet opening of the feeding means, the vertically aligned portions of the first and second track structures comprising a means for transferring vibratory movement from the first track structure, through any electrical contacts which are in vertical alignment with the first and second track structure, to the second track structure for inducing vibratory movement thereof; and means for supporting the second track structure in alignment with the inclined portion of the first track structure, with an inclination insufficient to permit sliding motion of the contacts along the second track structure absent vibratory movement thereof.

6. A crimping machine for serially advancing, feeding, and crimping electrical contacts of a type having a ferrule head portion and an elongated portion of smaller diameter than the head portion, the head portion defining a support surface, adjacent its periphery and facing the elongated portion, the center of gravity of the contacts lying between the support surface and distal end of the elongated portion, the apparatus comprising:

an annular hopper having a peripheral sidewall portion and a spiral pathway extending upwardly from the floor of the hopper to the sidewall, an outlet being formed through the sidewall adjacent the spiral pathway;

a first track structure, having first and second parallel strip members spaced apart to engage mutually opposite portions of the support surfaces of the electrical contacts, the first track structure having a proximate end connected to the hopper adjacent the outlet and extending tangentially from the outlet, the track structure comprising a means for engaging the contact support surfaces on opposite sides of the contacts and permitting movement of the contacts along the track during vibratory movement of the first track structure, the track structure having a downward inclination which is insufficient to permit sliding movement of the contacts without vibratory movement of the track structure;

vibratory means connected to the hopper for inducing vibratory movement of the bowl and the first track structure for causing contacts within the hopper to pass along the spiral pathway, through the outlet, and down the first track structure;

a crimping mechanism, having means for crimping the ferrule head portions of the contacts onto electrical wires inserted into the head portions;

feeding means for receiving the contacts and for sequentially feeding the electrical contacts into the crimping mechanism, the feeding means having an opening for receiving contacts to be fed to the crimping mechanism;

a second track structure connected to the feeding means and comprising means for receiving contacts from the first track structure and serially passing the contacts through the opening of the feeding means;

resonantly vibratory support means connected to the vibratory means, the feeding means and second track being mounted on the vibratory support means, the vibratory support means comprising means for supporting the second track structure in alignment with the first track structure and extending from the feeding means along an upward inclination insufficient to permit sliding motion, the support means comprising means for inducing vibratory movement in the second track structure for enhancing movement of the contacts along the second track structure and toward the inlet opening of the feeding means.

* * * * *